United States Patent [19]

Clark

[11] 4,156,549

[45] May 29, 1979

[54] INSECT PROOF DRAWER

[76] Inventor: Marvin A. Clark, Rte. 3, Box 777, Bartow, Fla. 33830

[21] Appl. No.: 854,005

[22] Filed: Nov. 22, 1977

[51] Int. Cl.[2] ..... A47B 88/00

[52] U.S. Cl. ..... 312/270; 312/292; 312/330 R

[58] Field of Search ..... 312/330 R, 270, 296, 312/292, 201, 122, 301

[56] References Cited

U.S. PATENT DOCUMENTS

| | | | |
|---|---|---|---|
| 337,798 | 3/1886 | Sweney | 312/330 R |
| 952,699 | 3/1910 | Brien | 312/270 |
| 1,866,464 | 7/1932 | Hallowell et al. | 312/201 |
| 2,182,962 | 12/1939 | Constantine et al. | 312/270 |
| 2,237,820 | 4/1941 | Hill | 312/270 |
| 2,576,508 | 11/1951 | Gluckman | 212/122 |
| 2,811,404 | 10/1957 | Brooks et al. | 312/330 R |
| 3,295,904 | 1/1967 | Cobb | 312/270 |
| 3,883,205 | 5/1975 | Ambaum et al. | 312/330 R |
| 3,973,814 | 8/1976 | Entrikin | 312/330 R |
| 3,984,163 | 10/1976 | Boorman, Jr. et al. | 312/270 |

*Primary Examiner*—Victor N. Sakran

*Attorney, Agent, or Firm*—Duckworth, Hobby, Allen & Pettis

[57] ABSTRACT

A drawer for preventing the entry of insects thereinto is mounted to slide in a frame and has grooves in the sides and front of the drawer. A cover is fixedly mounted in the frame and the drawer grooves slide on the edge of the cover. The cover engages the groove in the front of the drawer when the drawer is closed while the back of the drawer is sealed by the cover overlapping the back side, so that the drawer is sealed against the entry of insects when closed.

1 Claim, 1 Drawing Figure

INSECT PROOF DRAWER

BACKGROUND OF THE INVENTION

The present invention relates to drawers, cabinets, merchandise displays, and the like, and especially to a drawer designed to prevent the entry of insects when the drawer is closed.

In the past, drawers have been provided for a wide variety of cabinets, dressers, merchandise displays, and typically have a bottom and four sides, and slide on a framework which supports the drawer with bottom frame members and a bottom guide to ensure the drawer sliding straight in and out of the framework. It has also been typical in the past to provide suspended drawers, suspended from the side with special sliding brakcets, having roller bearings or the like, sliding in the brackets. The framework of the drawer typically would be covered to form a cabinet, dresser, or merchandise display counter, and sometimes the cabinets are sealed to prevent entry. The present invention, on the other hand, deals with an individual drawer, which is sealed against the entry of insects when the drawer is closed, and which does not effect the operation of the drawer. Typical prior patents may be seen in U.S. Patents to Ambaun, et al., U.S. Pat. No. 3,883,205, for a container comprising a box, a drawer and a flap hinged to the box, and in the Brooks, U.S. Pat. No. 2,811,404 for a merchandise display case with stackable merchandise drawers, and in the Hallowell, et al., U.S. Pat. No. 1,866,464, the Propst, et al., U.S. Pat. No. 3,826,550, and the Boorman, et al., U.S. Pat. No. 3,984,163.

SUMMARY OF THE INVENTION

The present invention relates to a drawer for preventing the entry of insects thereinto, which has a drawer with a front and back and two sides, and a bottom member. Each drawer side, along with the front, have elongated grooves therein along the top portion of the sides. The drawer may be mounted by conventional means to a framework or cabinet to slidably support the drawer therein. A cover plate is fixedly mounted to the framework or cabinet, and has two of its edges sliding in the grooves in the two sides of the drawer, and extending over the back of the drawer. The cover plate also has one edge that slides into the elongated groove in the front of the drawer when the drawer is closed, so that when the drawer is closed, the cover completely seals the drawer against the entry of insects.

THE DRAWINGS

Other objects, features and advantages of this invention will be apparent from the written description and the drawings, in which:

FIG. 1 is a fragmentary perspective view of a partially opened drawer, in accordance with the present invention.

DESCRIPTION OF THE PREFERRED EMBODIMENT

Figure 1:
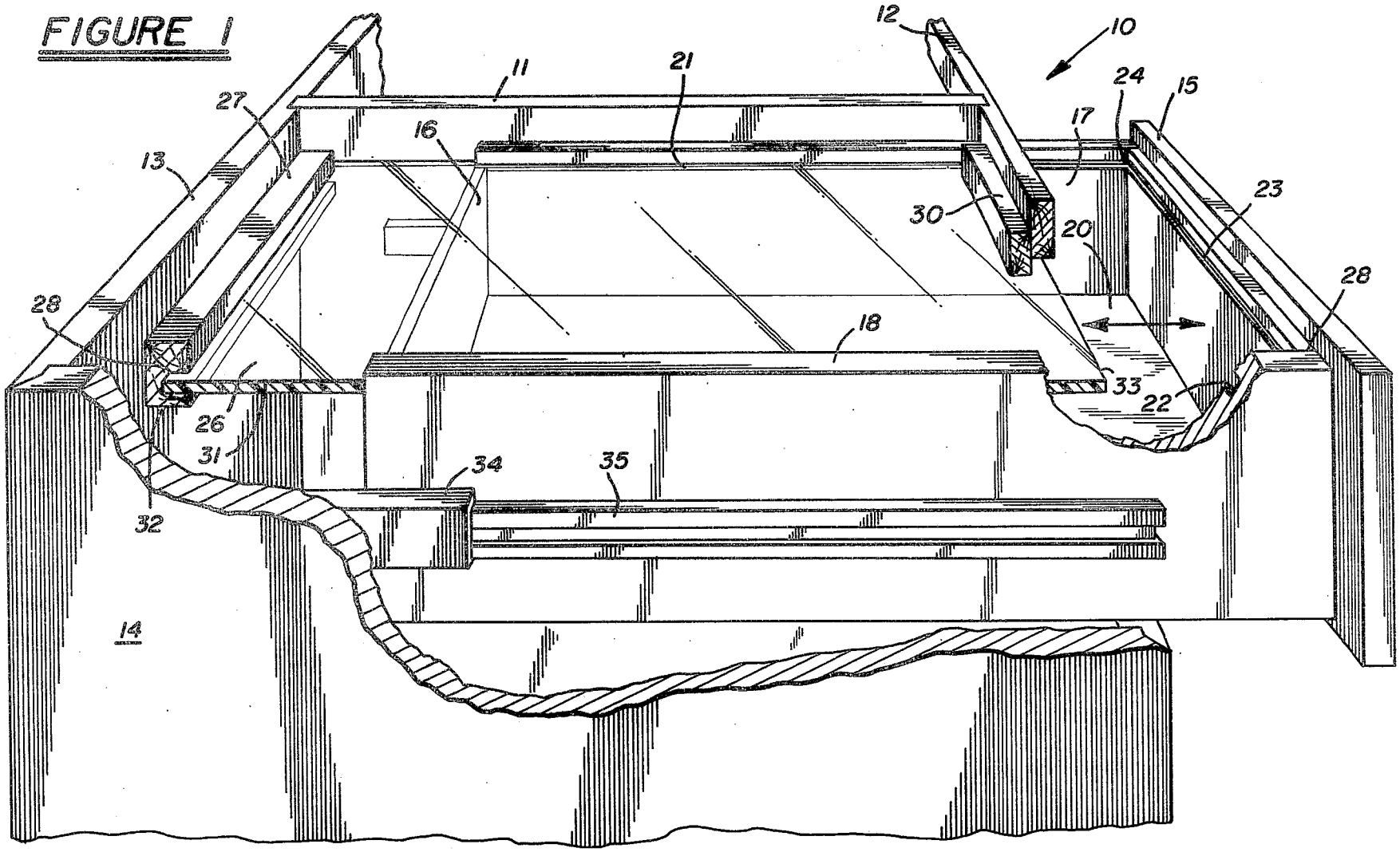

Referring to the drawer, a drawer 10 is provided mounted to frame numbers 11 and 12, and to a rear cabinet or frame member 13 and a side frame or cabinet member 14. The drawer 10 has a front 15, a rear 16, and a pair of sides 17 and 18, along with a bottom 20, as in most convention drawers of this type. The side 17 of the drawer 10, however, has an elongated groove 21, while the side 18 has an elongated groove 22, and the front 15 has an elongated groove 23. The grooves 21 and 22 join the groove 23 at mitered corners 24 and 25 to make one continuous groove around three sides of the drawer 10. A plexi-glass cover plate 26 is mounted in a cover plate supporting frame 27, which has an elongated groove 28 for mounting the edge of the plexi-glass cover in, and which is attached to the cabinet member 13. The cover 26 may be attached to the cover support frame 27 by an adhesive or the like. The cover 26 is supported to the front frame member 12 by the cover supporting frame member 30, which may be bolted or glued to the member 12, and may be attached to the plexi-glass with an adhesive. The side edges 31 of the cover 26 slide in the grooves 21 and 22 of the side members 17 and 18 of the drawer 10, so that the cover plates 26 must be of the exact size to always be riding in the grooves 21 and 22, while the rear 16 of the drawer 10 is shorter than the other sides, so that it rides against the bottom of the plexi-glass cover 26 to seal the back of the plexi-glass, and in addition, may abut against a surface 32 of the cover plate supporting member 27, when the drawer is closed to further seal entry from the back of the drawer 16. The front groove 23 is positioned to receive the front edge 33 of the cover plate 26 when the drawer 10 is closed, thereby sealing the drawer on three sides by the cover plate fitting in the continuous groove 21, 23, and 22 around the drawer when the drawer is closed. When the drawer is closed with the cover plate positioned inside of the cabinet, the cover plate is not visible and only the front lip of the cover plate 26 is visible when the drawer is opened. The drawer 10 may be mounted to the cabinet by a bracket 34 and sliding suspension member 35, which slides in the bracket 34 in a conventional manner, and which may ride on rollers if desired.

The present invention advantageously provides a drawer for preventing the entry of insects thereinto which looks and operates as a conventional drawer, which is opened in a conventional manner and closed in a conventional manner, but which is sealed when the drawer is closed. The drawer may, of course, be mounted in built-in cabinets, or in open frameworks and may be made of conventional materials such as wood using metal fasteners, adhesives, and the like. The cover plate 26 may be made of plexi-glass, but can of course be made of other materials as desired, and can be made transparent with the top portion of the cabinet open it if is desired to be able to view the inside of the drawer. The present invention, however, is not to be construed as limited to the particular forms disclosed herein, which are to be regarded as illustrative, rather than restrictive.

I claim:

1. A drawer for preventing the entry of insects thereinto, comprising in combination:

a drawer having a front, a back, two sides and a bottom, each said drawer side having an elongated groove therein along the top portion thereof;

drawer mounting means having means to slidably support said drawer including sliding drawer support brackets mounted to each side of said drawer and to said frame;

a cabinet having a cabinet frame for supporting a drawer with said sliding drawer bracket mounted thereto;

a transparent cover plate having a plurality of edges and top and bottom sides and being fixedly attached to said frame adjacent said drawer and having one edge protruding into each said drawer side groove to seal the sides of said drawer against the entry of insects, said cover plate being fixedly attached to the back and front portions of said frame along the one edge of the back portion by a grooved frame member with the rear edge of said cover member attached in said groove and said cover being fixedly attached to the top side of the front portion of said frame;

and means for sealing said cover plate to said drawer front and rear sides when closed, said means for sealing said cover plate to said drawer front and sides having a groove found in said drawer front side intersecting with said grooves in said drawer sides, so that the front edge of said cover plate will slide into said groove in said front side when said drawer is closed, and said means having the rear side positioned against the bottom of said cover plate and in sliding contact therewith whereby said drawer is sealed against the entry of insects when closed.

* * * * *